United States Patent [19]

Mitchell

[11] Patent Number: 5,054,121

[45] Date of Patent: Oct. 8, 1991

[54] ATHLETIC PAD

[75] Inventor: Hal D. Mitchell, Licking, Mo.

[73] Assignee: Figgie International Inc., Richmond, Va.

[21] Appl. No.: 467,154

[22] Filed: Feb. 8, 1990

Related U.S. Application Data

[63] Continuation of Ser. No. 238,113, Aug. 30, 1988, abandoned.

[51] Int. Cl.[5] ..... A41D 13/00

[52] U.S. Cl. ..... 2/2; 2/45

[58] Field of Search ..... 2/2, 16, 22, 24, 45

[56] References Cited

U.S. PATENT DOCUMENTS

| | | | |
|---|---|---|---|
| 1,721,739 | 7/1929 | Kennedy | 2/2 |
| 1,772,922 | 8/1930 | Volz | 2/22 |
| 1,772,923 | 8/1930 | Volz | 2/22 |
| 2,540,952 | 2/1951 | Kennedy | 2/2 |
| 2,568,105 | 9/1951 | Zagata | 2/268 |
| 2,953,789 | 9/1960 | Morgan et al. | 2/2 |
| 2,957,177 | 10/1960 | Turner | 2/2 |
| 4,354,280 | 10/1982 | Hayes | 2/16 |
| 4,641,641 | 2/1987 | Strock | 2/2 X |
| 4,953,569 | 9/1990 | Lonardo | 2/16 X |

*Primary Examiner*—Werner H. Schroeder
*Assistant Examiner*—Michael A. Neas
*Attorney, Agent, or Firm*—Senniger, Powers, Leavitt & Roedel

[57] ABSTRACT

A protective pad for body parts comprising an elongate protective outer plate of a substantially stiff but flexible material having a concave inner surface, and an inner ply of padding extending across the inner surface of the plate. A closed loop of stitching secures the inner ply to the marginal edges of the inner surface of the outer plate to suspend the inner ply taut and spaced inwardly from the central portion of the inner surface of the plate.

15 Claims, 1 Drawing Sheet

ATHLETIC PAD

This is a continuation of application Ser. No. 07/238,113, filed Aug. 30, 1988 now abandoned.

BACKGROUND OF THE INVENTION

This invention relates to protective pads, and in particular to protective pads that are adapted for use in athletic equipment such as football pants and shoulder pads.

Various types of protective pads have been developed to protect an athlete's body during participation in sports, and particularly in contact sports such as football and hockey. Some types of these protective pads include rigid plates to deflect impacts and to shield the underlying body parts. Others of these protective pads include resilient bodies to absorb the energy from impacts. In the design of these protective pads there are two primary, and often conflicting, interests: the provision of a pad that adequately protects the athlete and the provision of a pad that does not interfere with the athlete's movement or performance.

SUMMARY OF THE INVENTION

It is among the objects of the present invention to provide an effective protective pad that is thin, compact, and lightweight; to provide such a pad that is comfortable to wear and which does not unduly interfere with the athlete's movement or performance; to provide such a pad that shields or deflects sharp blows; to provide such a pad that diffuses and distributes the force of an impact over a large surface area; and to provide such a pad that can absorb and dissipate at least some of the energy of an impact.

Generally, an athletic pad constructed according to the principles of the present invention comprises a protective outer plate of a substantially stiff but flexible material having a concave inner surface; an inner ply of padding extending over the inner surface of the plate; and means for attaching the inner ply to the marginal edges of the inner surface of the outer plate to suspend the inner ply tautly over and spaced from the central portion of the inner surface of the plate.

In the preferred embodiment the inner ply of padding comprises a layer of foam padding in a cloth cover, and the inner ply is secured to the outer plate with a closed ring or loop of stitching.

The protective pad according to the present invention comprises two layers and is thus thin, compact, and lightweight. The inner ply of foam padding is comfortable against the body and thus the pad is comfortable to wear. The pad can be made small enough that it does not unduly interfere with the athlete's movement or performance. The stiff outer plate deflects sharp blows and impacts, shielding the body parts below. The space between the outer plate and the inner ply prevents the direct transmission of impact energy from the plate to the wearer. Instead the force of the impact is distributed over the entire contact area between the inner ply and the wearer. The pad also absorbs some of the energy of impacts. An impact on the outer plate forces the inner ply of padding against the body, tensioninq the ply of padding, which causes the stiff, flexible outer plate to flex. This flexing of the concave outer plate brings the edges of the plate closer to the wearer's body. This brings still more of the inner ply of the pad in contact with the wearer's body providing a larger contact surface over which to distribute the force of the impact. Furthermore the flexing of the plate absorbs and dissipates some of the impact energy.

These and other advantages will be in part aPparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
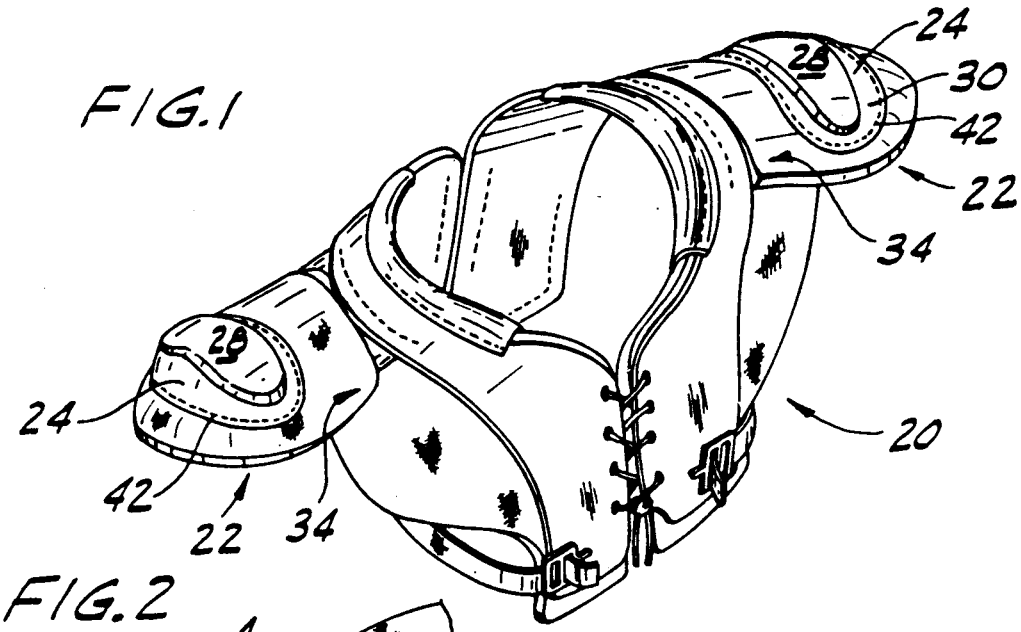
FIG. 1 is a perspective view of a football shoulder pad incorporating protective pads constructed according to the principles of this invention.

FIG. 1 shows a football shoulder pad 20 incorporating the protective pads 22 of the present invention. While the protective pads 22 are described herein as part of a football shoulder pad, the use of the pads 22 is not so limited, and the pads 22 may be incorporated in other athletic equipment, for example football pants.

Figure 2:
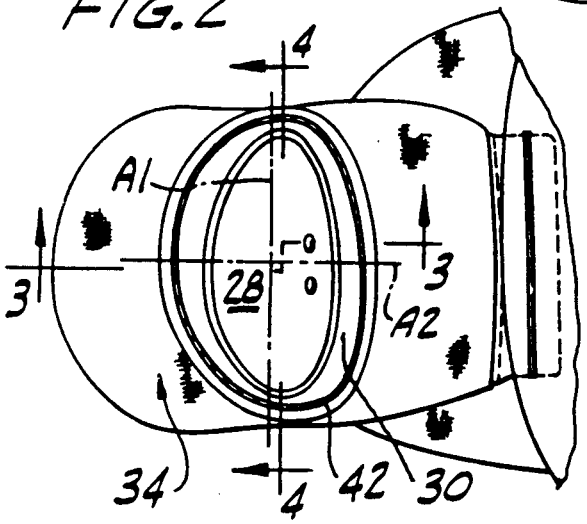
FIG. 2 is a top plan view of one of the protective pads incorporated into the football shoulder pad.
Figure 4:
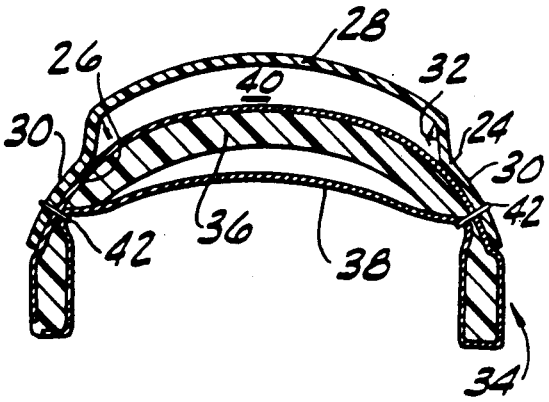
FIG. 4 is a cross-sectional view of the protective pad taken along the plane of line 4—4 in FIG. 2.
Figure 3:
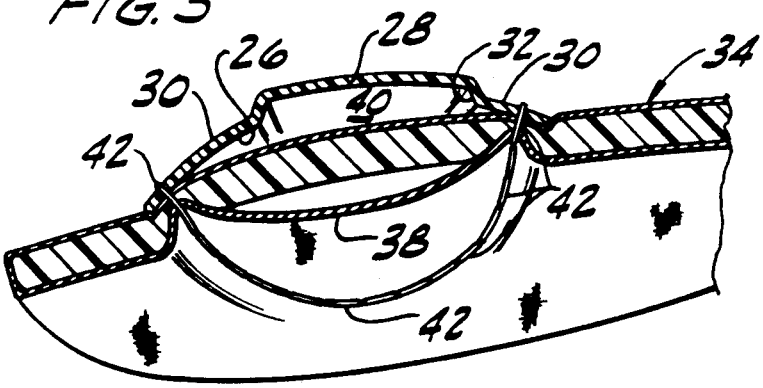
FIG. 3 is a cross-sectional view of the protective pad taken along the plane of line 3—3 in FIG. 2.

Each pad 22 comprises a protective outer plate 24 of a substantially stiff but flexible material having a concave inner surface 26. The central portion 28 of the outer surface of plate 24 is raised with respect to the marginal edge portions 30, to form a recess 32 in the concave inner surface. The outer plate 24 is preferably elongated in one d and preferably curves along this elongated axis A1 (FIG. 1 x FIG. 2) positioned on the body transverse to the extent of the arm, leg, or other body part it is protecting. In the preferred embodiment the outer plate 24 is generally elliptical.

The outer plate 24 is preferably made of a lightweight, impact resistant material that is capable of withstanding the impacts typically encounted in sporting events. For example the outer plate 24 may be made of high density polyethylene, or some other suitable material.

Each pad 22 further, comprises applicable inner ply of padding 34 extending across and spaced at least the inner surface 26 of the plate 24, and preferably beyond the marginal edges of the plate 24. The inner ply of padding 34 is preferably a layer of closed cell foam padding 36 in a nylon cloth cover 38.

The inner ply of padding 34 is attached to the the marginal edge portion 30 of the inner surface 26 of plate 24 so that the inner ply 34 is suspended that across and spaced inwardly from the inner surface 26 of the plate. There is thus an open space 40 between the inner ply and the outer plate. In the preferred embodiment the inner ply 34 is attached to the plate 24 with a ring or loop of stitching 42. In this preferred embodiment, the inner ply 34 is attached to the outer plate 24 with a generally elliptical line of stitching 42. This line of stitching is preferably concentric with the elliptical shape of the outer plate 24. Because the inner ply 34 is attached to the concave surface 26 of the plate 24, it assumes a generally concave shape to receive a body part such as a shoulder or knee joint.

The pad 22 is positioned over the portion of the body to be protected, with the inner surface of the inner ply 34 providing comfortable contact with the wearer's body. The stiff outer plate 24 deflects sharp impacts to the pad 22, shielding the underlying body parts. The pad 22 also dissipates at least some of the impact energy from direct impacts. The space 40 between the inner ply 34 and the outer plate 24 prevents the direct transfer of impact energy to the wearer's body. Instead the impact force is distributed over the entire contact surface between the inner ply 34 and the wearer's body. Furthermore, an impact to the plate 24 forces the plate 24 and the inner ply 34 against the wearer's body, increasing the area of contact between the inner ply and the wearer's body, thereby increasing the surface area over which the impact force is distributed. Moreover, as the inner ply 34 is pressed against the wearer's body it conforms thereto and becomes tensioned. This tensioning of the inner ply 34 causes the outer plate 24 to flex generally along a line A2 (see FIG. 2) perpendicular to elongate axis A1 of the plate 24. Preferably, as described above, the plate 24 curves along the elongate axis of the plate 24, which facilitates this flexing. In the preferred embodiment, where the outer plate 28 is elliptical, the plate generally flexes about the minor axis of the ellipse. This flexing causes the edges of the plate 24 to flex inwardly, around the underlying body part, bringing still more of the inner ply 34 in contact with the body, further increasing the contact area over which the impact force is distributed. This mechanical flexing also absorbs and dissipates at least some of the impact energy of blows to the pad 22.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A protective device for body parts comprising:
a protective outer plate of a substantially stiff but flexible material having a concave inner surface;
a pliable inner ply extending across the inner surface of the plate for overlying a part of the body of the wearer;
a closed loop of stitching securing the inner ply to the edge margins of the inner surface of the outer plate to suspend the inner ply taut and spaced inwardly from the central portion of the inner surface of the outer plate so that tensioning of the inner ply, as occurs upon an impact to the outer plate, pulls portions of the edge margins of the outer plate toward each other to flex the outer plate thus increase the contact area between the inner ply and the wearer, thereby increasing the area for distributing the force of the impact.

2. The device according to claim 1 wherein the outer plate is elongate.

3. The device according to claim 1 wherein the closed loop of stitching is elongated.

4. The device according to claim 1 wherein the outer plate is elongate and concavely curved along its elongate axis to flex about a line perpendicular to the elongate axis.

5. The device according to claim 4 wherein the outer plate is generally elliptical.

6. The device according to claim 5 wherein the closed loop of stitching is generally elliptical, and concentric with the elliptical shape of the outer plate.

7. The device according to claim 1 wherein the inner ply extends beyond the periphery of the outer plate.

8. A protective device for body parts comprising:
an elongate protective outer plate of a substantially stiff but flexible material having a concave inner surface;
a pliable inner ply of padding extending across the inner surface of the plate;
a closed loop of stitching securing the inner ply to the edge margins of the inner surface of the outer plate to suspend the ply taut and spaced inwardly from the central portion of the inner surface of the plate so that tensioning of the inner ply, as occurs upon an impact to the outer plate, pulls portions of the edge margins of the outer plate toward each other to flex the outer plate and thus increase the contact area between the inner ply and the wearer, thereby increasing the area for distributing the force of the impact.

9. The device according to claim 8 wherein the loop of stitching is elongate.

10. The device according to claim 8 wherein the outer plate is concavely curved along its elongate axis and can flex about a line perpendicular to the direction of elongation.

11. The device according to claim 10 wherein the outer plate is generally elliptical.

12. The device according to claim 11 wherein the closed loop of stitching is generally elliptical, and concentric with the elliptical shape of the outer plate.

13. The device according to claim 8 wherein the inner ply extends beyond the periphery of the outer plate.

14. A protective device for body parts comprising:
an elongate protective outer plate of a substantially stiff but flexible material having a concave inner surface, the outer plate having a width substantially less than its length and being concavely curved along its elongate axis to flex about a line perpendicular to the direction of elongation;
a pliable inner ply of padding extending across the inner surface of the plate;
a closed elongate loop of stitching securing the inner ply to the marginal edges of the inner surface of the outer plate to suspend the ply taut and spaced inwardly from the central portion of the inner surface of the plate so that tensioning of the inner ply, as occurs upon an impact to the outer plate, pulls portion of the marginal edges of the outer plate toward each other to flex the outer plate and thus increase the contact area between the inner ply and the wearer, thereby increasing the area for distributing the force of the impact.

15. The device according to claim 14 wherein the outer plate is generally elliptical.

* * * * *